US008912828B2

(12) United States Patent
Huang et al.

(10) Patent No.: US 8,912,828 B2
(45) Date of Patent: Dec. 16, 2014

(54) DRIVING CIRCUIT OF FLAT DISPLAY

(71) Applicant: Novatek Microelectronics Corp., Hsinchu (TW)

(72) Inventors: Ju-Lin Huang, Hsinchu County (TW); Yueh-Hsiu Liu, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 3 days.

(21) Appl. No.: 13/794,811

(22) Filed: Mar. 12, 2013

(65) Prior Publication Data

US 2013/0342109 A1 Dec. 26, 2013

(30) Foreign Application Priority Data

Jun. 22, 2012 (TW) ..... 101122435 A

(51) Int. Cl.
*H03B 1/00* (2006.01)
*H05B 37/02* (2006.01)
*G09G 3/20* (2006.01)

(52) U.S. Cl.
CPC ..... *H05B 37/02* (2013.01); *G09G 2330/021* (2013.01); *G09G 2310/0291* (2013.01); *G09G 2330/045* (2013.01); *G09G 3/20* (2013.01)
USPC ..... 327/108; 327/112; 327/391

(58) Field of Classification Search
USPC ..... 327/108–112, 379, 389, 391, 427; 345/204, 690, 214
See application file for complete search history.

(56) References Cited

U.S. PATENT DOCUMENTS

2003/0160749 A1 8/2003 Tsuchi
2006/0164368 A1 7/2006 Tobita
2012/0280959 A1* 11/2012 Shiu et al. ..... 345/211
2013/0181749 A1* 7/2013 Hamanaka ..... 327/109

FOREIGN PATENT DOCUMENTS

TW 529240 4/2003
TW 201106317 2/2011

* cited by examiner

*Primary Examiner* — Long Nguyen
(74) *Attorney, Agent, or Firm* — Jianq Chyun IP Office

(57) ABSTRACT

A driving circuit of flat display including a charging circuit path, a discharging circuit path, and a detecting circuit is provided. The charging circuit path has first and second impedance states, wherein an impedance value of the first impedance state is smaller than that of the second impedance state. The discharging circuit path has third and fourth impedance states, wherein an impedance value of the third impedance state is smaller than that of the fourth impedance state. The detecting circuit detects whether the charging circuit path or the discharging circuit path is in an unstable first state or stable second state, controls the charging circuit path to the first impedance state or the discharging circuit path to the third impedance state in the first state, and controls the charging circuit path to the second impedance state or the discharging circuit path to the fourth impedance state in the second state.

19 Claims, 6 Drawing Sheets

DRIVING CIRCUIT OF FLAT DISPLAY

CROSS-REFERENCE TO RELATED APPLICATION

This application claims the priority benefit of Taiwan application serial no. 101122435, filed on Jun. 22, 2012. The entirety of the above-mentioned patent application is hereby incorporated by reference herein and made a part of this specification.

BACKGROUND

1. Technical Field

The invention relates to a driving circuit of a flat display. Particularly, the invention relates to a driving circuit having a thermal-reducing effect.

2. Related Art

A display panel of a flat display is composed of a pixel array. Each pixel may contain a plurality of sub-pixel colors corresponding to primary colors, and display a brightness of a color according to a required gray level, so as to form the color of a color pixel. A driving voltage of each pixel varies with the gray level. Regarding dynamic images, the display panel continuously displays new frames according to a frequency, and accordingly charges/discharges the driven pixels.

FIG. 1 is a schematic diagram of a conventional driving circuit of a flat display. The conventional driving circuit 102 of the flat display receives a voltage input signal Vin of a voltage input circuit 100 to charge or discharge a pixel capacitor 116 of a corresponding pixel of a display panel 104 of the flat display, so as to achieve a voltage corresponding to the voltage input signal Vin to display a desired gray level. In a general structure, the voltage input circuit 100, such as an operation amplifier, amplifies to a voltage used for controlling the driving circuit according to a digital gray level, which is referred to as Vin. The driving circuit 102 charges the pixel capacitor 116 of the pixel, and the pixel circuit has a pixel resistance 114 represented by an impedance value of RP.

The driving circuit 102 generally includes a charging circuit path and a discharging circuit path. The charging circuit path, for example, includes a P-type metal oxide semiconductor (PMOS) transistor 106, a switch 110 and an electrostatic discharge (ESD) element 112, and impedances thereof are respectively represented by RSP, RS and RE. The discharging circuit path, for example, includes an NMOS transistor 108, the switch 110 and the ESD element 112. An impedance of the NMOS transistor 108 is represented by RSN. Gates of the PMOS transistor 106 and the NMOS transistor 108 are controlled by the voltage input circuit 100 under normal operation, and conducting levels of the transistors are controlled by the gray levels.

In a charging stage, a system high voltage VDD is received, and the pixel capacitor 116 is charged according to the input voltage Vin. A capacitance of the pixel capacitor 116 is represented by CP, which becomes stable after a period of time, and an output voltage Vout at an output terminal of the driving circuit 102 increases with time in the charging stage. In a discharging stage, a ground voltage provides a discharging voltage.

Since the internal impedance of the driving circuit may have power consumption during a driving process, heat is generated. When a pixel density increases, the generated heat cannot be ignored. Therefore, it is an important issue in research and development to reduce a temperature of the driving circuit.

SUMMARY

The invention is directed to a driving circuit of a flat display, which has a thermal-reducing effect.

The invention provides a driving circuit of a flat display, which has an output terminal for driving pixels of a display panel to display. The driving circuit includes a charging circuit path, a discharging circuit path, and a detecting circuit. The charging circuit path is configured to charge pixels of the display panel, and has a first impedance state and a second impedance state. An impedance value of the first impedance state is smaller than an impedance value of the second impedance state. The discharging circuit path is configured to discharge the pixels of the display panel, and has a third impedance state and a fourth impedance state. An impedance value of the third impedance state is smaller than an impedance value of the fourth impedance state. The detecting circuit detects whether or not the charging circuit path or the discharging circuit path is in a first state of a charging/discharging stage or in a second state with voltage approaching to a stable state. In the first state, the detecting circuit controls the charging circuit path to the first impedance state or controls the discharging circuit path to the third impedance state. In the second state, the detecting circuit controls the charging circuit path to the second impedance state or controls the discharging circuit path to the fourth impedance state.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
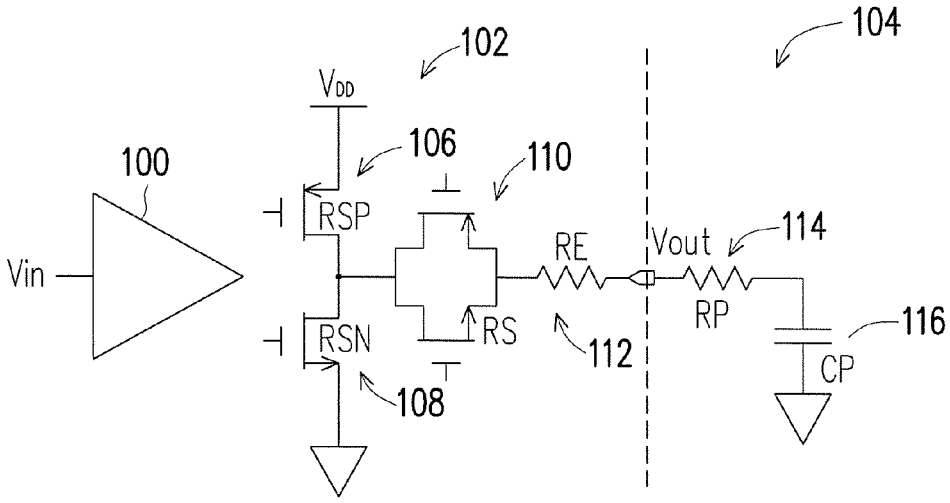
FIG. 1 (Prior Art)
FIG. 1 is a schematic diagram of a conventional driving circuit of a flat display.

The conventional circuit of FIG. 1 is first considered, in which a temperature of a driving chip increases as a load or a frame rate of the panel increases, which deteriorates a characteristic and reliability of the driving chip and the panel. In the invention, a heat source of the driving chip is detected, and the heat is mainly caused by an internal impedance of an output terminal of the driving circuit when charges used for charging and discharging the flat display flow through the driving circuit. The internal impedance of the output terminal is represented by RIC, and when the panel is charged, RIC=RSP+RS+RE, and when the panel is discharged, RIC=RSN+RS+RE. The heat generated by the driving circuit is $PIC=I^2\times RIC$, where I represents charges flowing through the internal resistance of the driving circuit in each charge and discharge cycle of the flat display, and since the loads RP and CP of the panel are fixed values, the charges I provided by the driving circuit are unchanged.

Therefore, if the internal impedance RIC of the output terminal of the driving circuit is decreased, the temperature of the driving circuit is decreased. However, if the internal impedance is arbitrarily changed, features such as stability of the driving circuit of the original design or the discharging capability of the ESD element are changed.

An embodiment of the invention provides a circuit structure capable of dynamically changing the internal impedance of the output terminal of the driving circuit, in which the internal impedance of the driving circuit is decreased in an initial stage of a charging/discharging stage, and after the charging/discharging is completed, the originally designed internal impedance is recovered. In this way, the power consumption is reduced during the charging/discharging process to reduce the heat generation without influencing a normal display operation.

Figure 2:
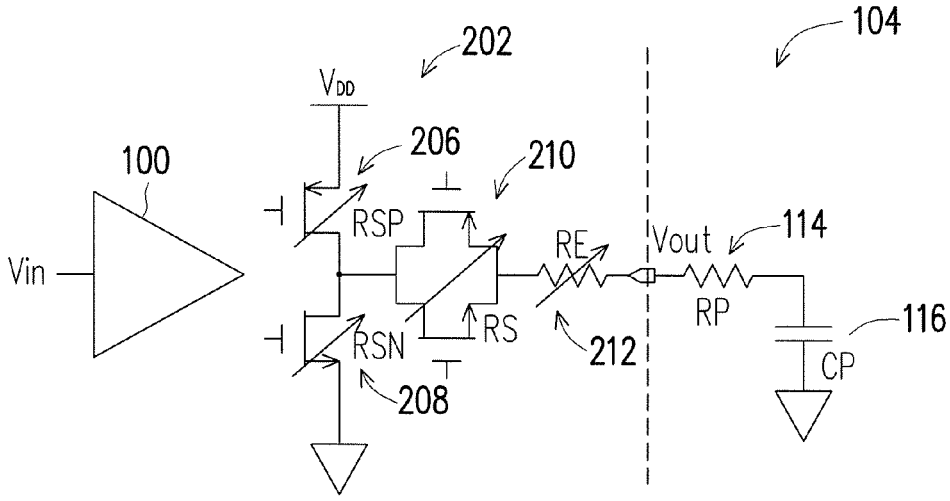
FIG. 2 is a schematic diagram of a driving circuit of a flat display according to an embodiment of the invention.

FIG. 2 is a schematic diagram of a driving circuit of a flat display according to an embodiment of the invention. Referring to FIG. 2, compared to the conventional circuit of FIG. 1, the internal impedance of the driving circuit 202 of the present embodiment can be dynamically changed in the charging stage or the discharging stage.

The driving circuit 202 may include a charging circuit path and a discharging circuit path. Moreover, a detecting circuit is used to detect whether the charging circuit path or the discharging circuit path is in a charging state or a discharging state. The detecting circuit can be configured in internal or at external of the driving circuit 202, which is determined according to an actual design requirement. The detecting circuit of the present embodiment is not illustrated in FIG. 2, though detailed circuit designs thereof are introduced in the embodiments of FIG. 3 and FIG. 7.

The charging circuit path, for example, includes a field-effect transistor circuit 206, a switch circuit 210 and an ESD circuit 212. The discharging circuit path, for example, includes a field-effect transistor circuit 208, the switch circuit 210 and the ESD circuit 212. The switch circuit 210 turns off or turns on the charging the charging circuit path or the discharging circuit path to charge or discharge the pixels according to an actual operation requirement. In designs of other driving mechanisms, the switch circuit 210 can also be omitted.

The charging circuit path is used to charge the pixels of the display panel 104, and the charging circuit path has a first impedance state and a second impedance state. An impedance value of the first impedance state is smaller than an impedance value of the second impedance state.

The discharging circuit path is used to discharge the pixels of the display panel 104, and the discharging circuit path has a third impedance state and a fourth impedance state. An impedance value of the third impedance state is smaller than an impedance value of the fourth impedance state.

Figure 3:
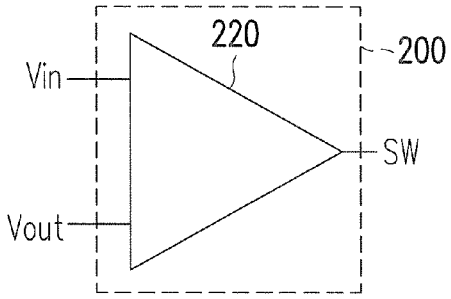
FIG. 3 is a schematic diagram of a detecting circuit according to an embodiment of the invention.
Figure 7:
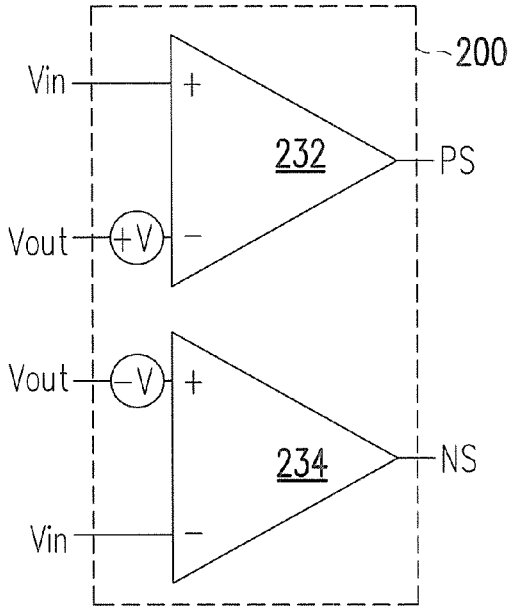
FIG. 7 is a schematic diagram of a detecting circuit 200 according to an embodiment of the invention.

The detecting circuit, as that shown in FIG. 3 and FIG. 7, is used to detect whether the charging circuit path or the discharging circuit path is in a first state of the charging/discharging stage or in a second state with voltage approaching to a stable state. In the first state, a component is, for example, added to form a parallel circuit to reduce the internal impedance. In the second state, the added component is turned off to recover the impedance state of the original driving circuit design.

In other words, in the first state of the driving circuit 202, the detecting circuit controls the charging circuit path to the first impedance state or controls the discharging circuit path to the third impedance state. In the second state of the driving circuit 202, the detecting circuit controls the charging circuit path to the second impedance state or controls the discharging circuit path to the fourth impedance state.

By reducing the impedance of the driving circuit, in the charging/discharging stage, the power consumption of the driving circuit is reduced to reduce a heat generation amount, so as to reduce the temperature. After the charging/discharging is completed, the impedance state of the original design is recovered, so that the normal display is not influenced.

There is a plurality of methods for detecting whether the driving circuit is in the charging/discharging stage, and for example, it can be directly determined through a RC characteristic curve according to a time of the voltage input signal Vin. Moreover, the voltage input signal Vin and the output voltage Vout can be directly compared to determine whether the charging or discharging is nearly completed, and a more accurate situation is to actually detect completion of the charging/discharging.

FIG. 3 is a schematic diagram of a detecting circuit according to an embodiment of the invention. Referring to FIG. 3, the detecting circuit 200 may have different designs under a same effect. For example, the voltage input signal Vin and the output voltage Vout are compared to output a required control signal. The detecting circuit 200, for example, includes a comparator 220, which receives the voltage input signal Vin and the output voltage Vout, and detects whether the output voltage Vout is close to the voltage input signal Vin. Although it is Vout=Vin in an ideal state, regarding the charging stage, the driving circuit is in the charging stage as long as the output voltage Vout is smaller than the voltage input signal Vin. Regarding the discharging stage, the driving circuit is in the discharging stage as long as the output voltage Vout is greater than the voltage input signal Vin. Therefore, the impedance of the original driving circuit is recovered as the signals are close by more than 50%, or even more than 80%, 90% or 95%. An output signal SW of the detecting circuit 200 or a signal SWB inverted to the signal SW can all be used as the control signal. A circuit layout of the detecting circuit 200 can be varied with different detecting mechanisms.

Figure 4:
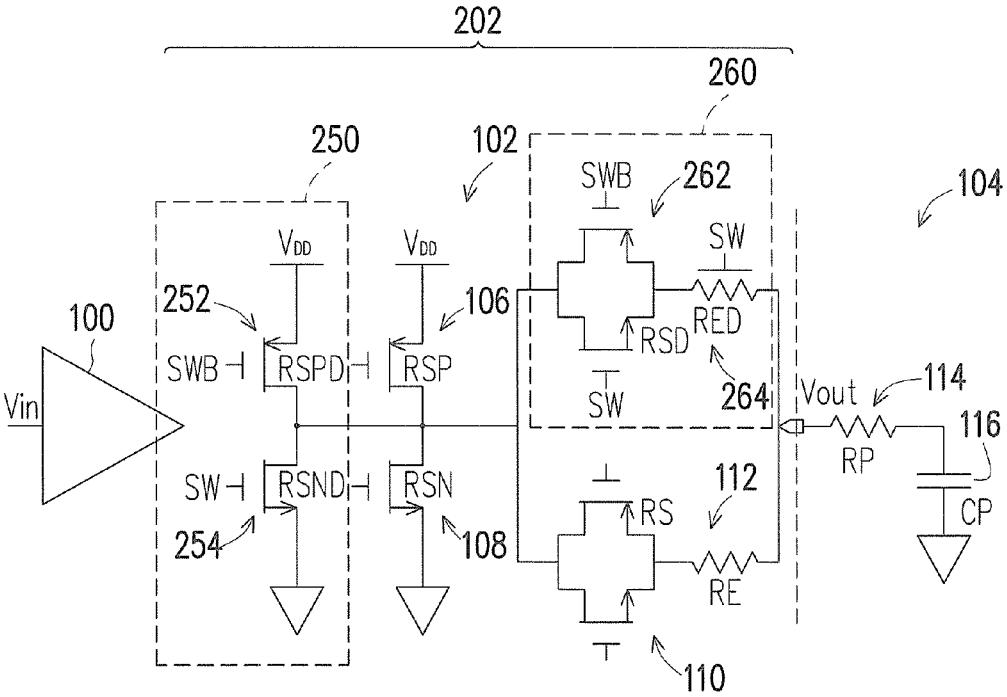
FIG. 4 is a schematic diagram of a driving circuit of a flat display according to an embodiment of the invention.

FIG. 4 is a schematic diagram of a driving circuit of a flat display according to an embodiment of the invention. Referring to FIG. 4, some circuits are, for example, added to the circuit of FIG. 2 to form a parallel connection to reduce the impedance.

In the driving circuit 202 of the present embodiment, the charging circuit path includes a MOS transistor 106 corresponding to the field-effect transistor circuit 206 of FIG. 2, where a gate of the MOS transistor 106 is controlled by the voltage input circuit 100 according to the input voltage signal Vin. In the present embodiment, a circuit path 250 connected in parallel is added, which includes a P-type MOS transistor 252 and an N-type MOS transistor 254. The MOS transistor 252 and the MOS transistor 106 are connected in parallel, and a gate of the MOS transistor 252 is controlled by the output of the detecting circuit 200 for turning on/off the MOS transistor 252, so as to change the impedance state.

Regarding the discharging circuit path includes a MOS transistor 108 corresponding to the field-effect transistor circuit 208 of FIG. 2, where a gate of the MOS transistor 106 is controlled by the voltage input circuit 100 according to the input voltage signal Vin. In the present embodiment, an MOS transistor 254 is added, where the MOS transistor 254 and the MOS transistor 108 are connected in parallel, and a gate of the MOS transistor 254 is controlled by the output of the detecting circuit 200 for turning on/off the MOS transistor 254, so as to change the impedance state.

It should be noticed that conductivities of the MOS transistors 106, 108, 252 and 254 can be the same or different, and in case of different conductivities, the transistors can be exchanged, and only the control voltages of the gates thereof are accordingly changed. The MOS transistor 106 and the MOS transistor 252 are, for example, PMOS transistors, and a voltage for causing a conducting state, called as a conducting voltage, thereof is a ground voltage. The MOS transistor 108 and the MOS transistor 254 are, for example, NMOS transistors, and a conducting voltage thereof is a positive voltage.

In the present embodiment, in addition to the common switch circuit 210 and the ESD circuit 212, a circuit path including a switch 262 and an ESD element 264 is added. The ESD element 264 also includes a switch that is controlled by the defecting circuit 200. In case that the switch circuit 210 is turned on, the switch 262 and the ESD element 264 are turned on according to whether the driving circuit is in the charging/discharging stage or is turned off at other stage.

Figure 5:
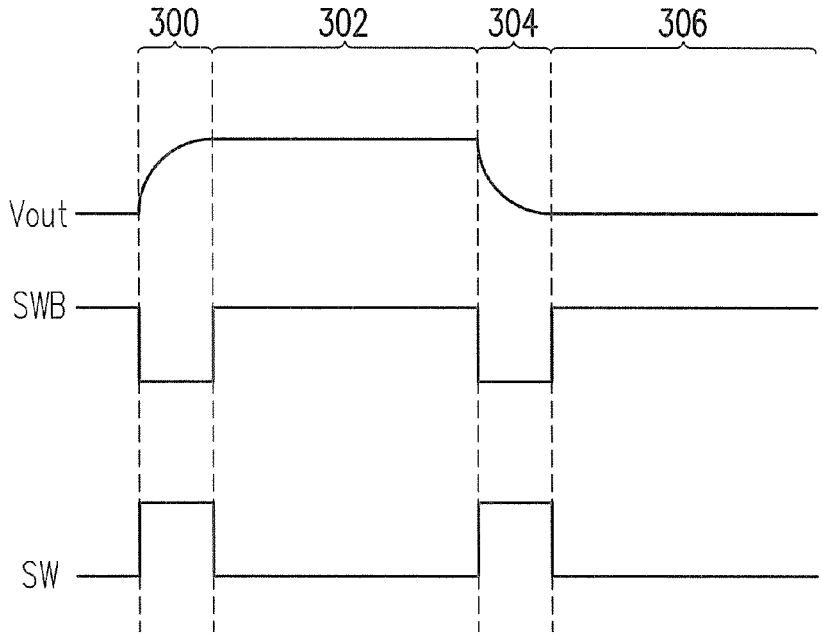
FIG. 5 is a schematic diagram illustrating a control mechanism of a driving circuit 202 of FIG. 4 according to an embodiment of the invention.

FIG. 5 is a schematic diagram illustrating a control mechanism of the driving circuit 202 of FIG. 4 according to an embodiment of the invention. Referring to FIG. 5, the detecting circuit 200 detects the output voltage Vout in a charging period 300, stable periods 302 and 306 or a discharging period 304. The charging period 300 and the discharging period 304 correspond to the first state, and the stable period 302 corresponds to the second state. In the present embodiment, the stable periods 302 and 306 are, for example, completely stable. However, as described above, it can be set to a certain approaching level.

In the present embodiment, the added components would respectively add impedance values, respectively represented by RSPD, RSND, RSD and RED as an example, which are the additional output stage impedance of the driving circuit. In the charging stage and the discharging stage of the output terminal of the driving circuit, the signal SW has a high voltage level, and the signal SWB has a low voltage level, so that the output impedance of the driving circuit is decreased due to a parallel connection of the impedances. In the stable periods 302 and 306 after the output terminal of the driving circuit completes the charging and discharging operations, the signal SW has a low voltage level, and the signal SWB has a high voltage level, so that the driving circuit recovers the normal operation, by which a thermal-reducing effect is achieved without influencing an original feature.

Figure 6:
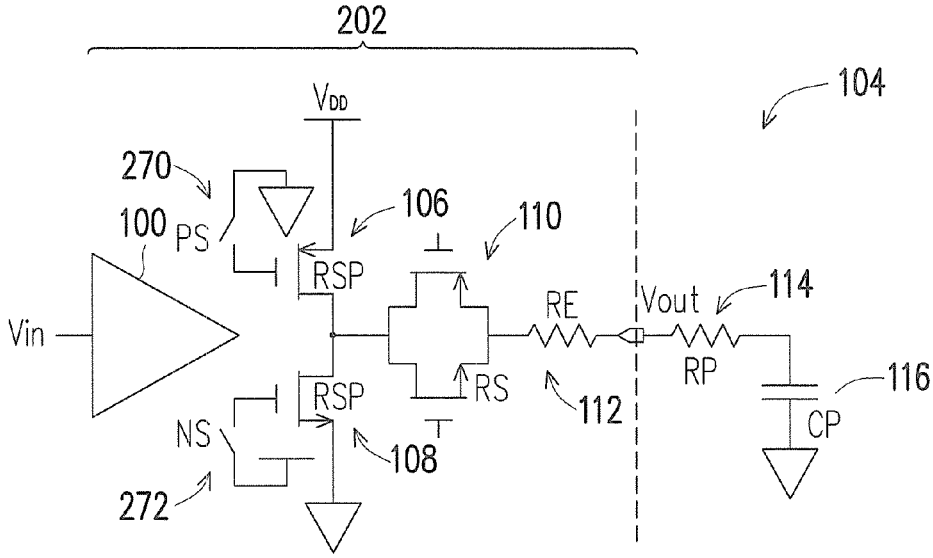
FIG. 6 is a schematic diagram of a driving circuit of a flat display according to an embodiment of the invention.

FIG. 6 is a schematic diagram of a driving circuit of a flat display according to an embodiment of the invention. Referring to FIG. 6, in another design of the driving circuit, the P-type MOS transistor 106 and the N-type MOS transistor 108 can be directly controlled by switches 270 and 272, so that the transistors 106 and 108 are completely turned on during the charging/discharge stage, so as to reduce the impedance. Regarding the P-type MOS transistor 106, when the switch 270 is turned on, the ground voltage is transmitted to turn on the P-type MOS transistor 106. Regarding the N-type MOS transistor 108, when the switch 272 is turned on, a high voltage is transmitted to turn on the N-type MOS transistor 108.

Figure 8:
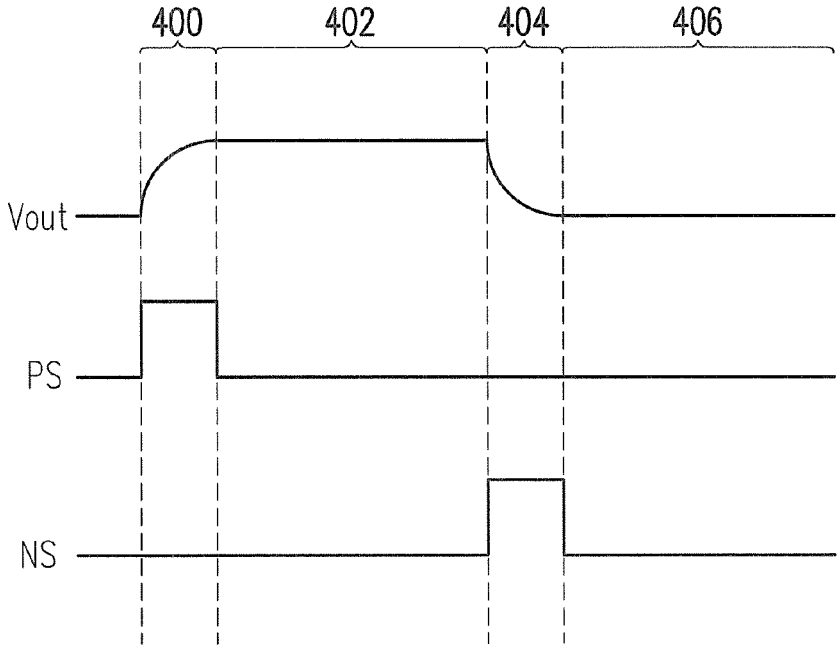
FIG. 8 is a schematic diagram illustrating a control mechanism of a driving circuit 202 of FIG. 6 according to an embodiment of the invention.

Due to different control mechanisms, designs of the detecting circuit 200 are also different. FIG. 7 is a schematic diagram of the detecting circuit 200 according to an embodiment of the invention. Referring to FIG. 7, the detecting circuit 200 includes two comparators 232 and 234, which respectively output signals PS and NS for controlling the switches 270 and 272 of FIG. 6. FIG. 8 is a schematic diagram illustrating a control mechanism of the driving circuit 202 of FIG. 6 according to an embodiment of the invention.

Referring to FIG. 6 and FIG. 8, the signals PS and NS serve as gate turn-on voltages to control the P-type MOS transistor 106 and the N-type MOS transistor 108. In a charging stage 400 of the driving circuit, the signal PS turns on the switch 270, and the signal NS turns off the switch 272, and since the P-type MOS transistor 106 is completely turned on, the impedance RSP thereof is decreased. In a discharging stage 404, the signal PS turns off the switch 270, and the signal NS turns on the switch 272. When the N-type MOS transistor 108 is completely turned on, the impedance RSN thereof is decreased. After the driving circuit completes the charging/discharging operation, the signals PS and NS simultaneously turn off the switches 270 and 272. Now, the P-type MOS transistor 106 and the N-type MOS transistor 108 are recovered to the original impedances RSP and RSN according to the design of the driving circuit 202. The impedance of the output terminal of the driving circuit 202 is decreased in the charging/discharging stage. The impedance of the output terminal is recovered after the charging/discharging operation is completed. In this way, the driving circuit may have a thermal-reducing effect, and the characteristic of the original driving circuit is not influenced.

Figure 9:
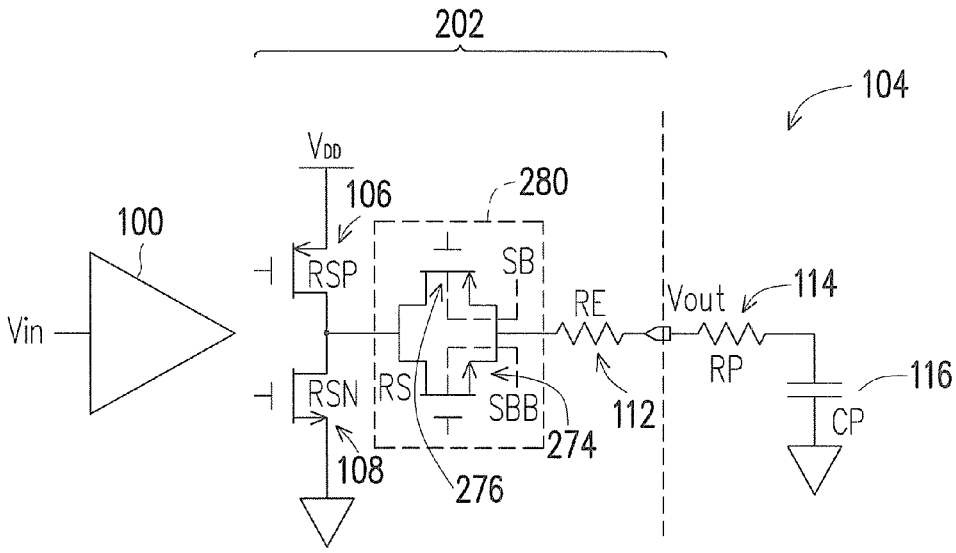
FIG. 9 is a schematic diagram of a driving circuit of a flat display according to an embodiment of the invention.

FIG. 9 is a schematic diagram of a driving circuit of a flat display according to an embodiment of the invention. Referring to FIG. 9, according to another design of the driving circuit, for example, the impedance reduction of a switch circuit 280 can be implemented by controlling a base voltage of the MOS transistor. The switch circuit 280 is, for example, composed of an N-type MOS transistor 274 and a P-type MOS transistor 276 connected in parallel. The base voltages of the N-type MOS transistor 274 and the P-type MOS transistor 276 are provided by a signal SBB and a signal SB.

Figure 10:
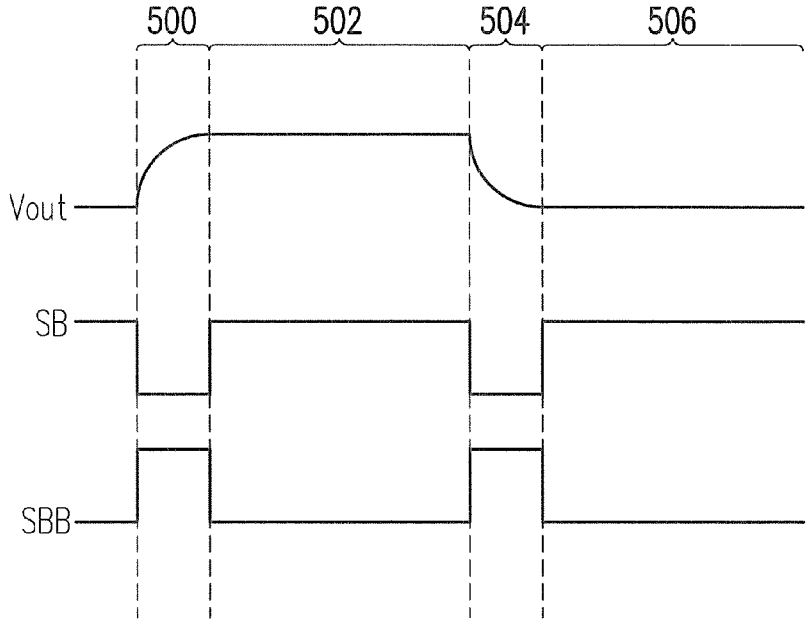
FIG. 10 is a schematic diagram illustrating a control mechanism of a driving circuit 202 of FIG. 9 according to an embodiment of the invention.

FIG. 10 is a schematic diagram illustrating a control mechanism of the driving circuit 202 of FIG. 9 according to an embodiment of the invention. Referring to FIG. 9 and FIG. 10, the signals SB and SBB are base voltage signals used for controlling the switch circuit 280 of the output terminal of the driving circuit. In charging and discharging stages 500 and 504 of the driving circuit, the signal SB can be decreased to a signal lower than a high voltage, and meanwhile the signal SBB can be increased to a signal higher than a low voltage, though the MOS transistors are not forward bias conducted, so that an output terminal impedance RS is decreased. In the stable stages 502 and 506 of the driving circuit after the charging and discharging operations are completed, the signals SB and SBB are respectively recovered to the high voltage and the low voltage, so that the output terminal impedance RS is unchanged. In this way, the driving circuit may have a thermal-reducing effect, and the characteristic of the original driving circuit is not influenced.

The detecting circuit 200 detects whether the charging/discharging stage is completed by analysing a voltage increasing/decreasing degree of the output voltage Vout. However, it can also be set according to the time of the input voltage signal Vin.

Figure 11:
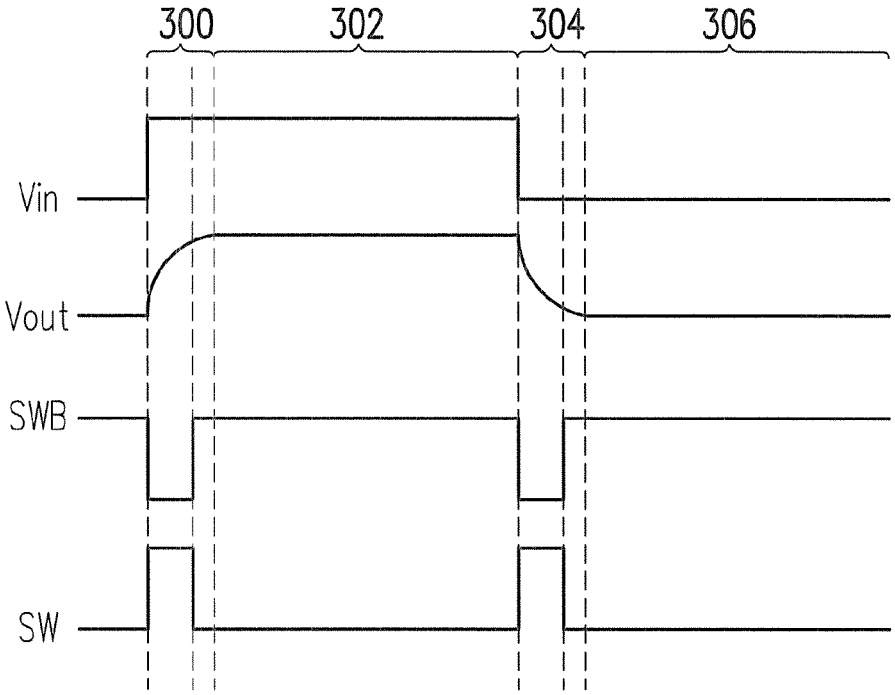
FIG. 11 is a schematic diagram illustrating a detecting mechanism of a detecting circuit according to an embodiment of the invention.

FIG. 11 is a schematic diagram illustrating a detecting mechanism of a detecting circuit according to an embodiment of the invention. Referring to FIG. 11, in which the control signals of FIG. 5 are shown, and the signals SW and SWB are generated within a period of time according to the input voltage signal Vin and an estimated RC constant. The heat generation is reduced as long as the impedance is reduced within the charging stage 300 or the discharging stage 304, and it is unnecessary to require the driving circuit to be completely in an impedance reduction state during all of the charging and discharging periods. Therefore, the widths of the signals SW and SWB can be set by suitably estimate the RC constant without applying 100% estimation, which can be more than 50%. The same method can also be used to change the signals of FIG. 8 and FIG. 10.

Several embodiments are provided above, though the invention is not limited thereto, and as long as the output impedance is reduced to achieve a thermal-reducing effect during the charging/discharging stage of the driving circuit, it is considered to match the spirit of the invention. Moreover, the provided embodiments can be suitably combined.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving circuit of a flat display, having an output terminal for driving pixels of a display panel to display, and comprising:

a charging circuit path, configured to charge the pixels of the display panel, and having a first impedance state and a second impedance state, wherein an impedance value of the first impedance state is smaller than an impedance value of the second impedance state;

a discharging circuit path, configured to discharge the pixels of the display panel, and having a third impedance state and a fourth impedance state, wherein an impedance value of the third impedance state is smaller than an impedance value of the fourth impedance state; and a detecting circuit, detecting whether or not the charging circuit path or the discharging circuit path is in a first state of a charging/discharging stage or in a second state with voltage approaching to a stable state, wherein in the first state, the detecting circuit controls the charging circuit path to the first impedance state or controls the discharging circuit path to the third impedance state, and in the second state, the detecting circuit controls the charging circuit path to the second impedance state or controls the discharging circuit path to the fourth impedance state.

2. The driving circuit of the flat display as claimed in claim 1, wherein the detecting circuit determines the first state or the second state by analysing an input voltage and an output voltage.

3. The driving circuit of the flat display as claimed in claim 1, wherein the charging circuit path comprises:

a first field-effect transistor circuit, having a first terminal and a second terminal, wherein the first terminal is connected to a system high voltage; and an electrostatic discharge (ESD) circuit, having a first terminal coupled to the second terminal of the first field-effect transistor circuit, and a second terminal connected to the output terminal, the discharging circuit path comprises:

a second field-effect transistor circuit, having a first terminal connected to a ground voltage and a second terminal; and the ESD circuit in common use, wherein the second terminal of the second field-effect transistor circuit is connected to the second terminal of the first field-effect transistor circuit and is connected to the first terminal of the ESD circuit.

4. The driving circuit of the flat display as claimed in claim 3, wherein the first field-effect transistor circuit comprises:

a first metal oxide semiconductor (MOS) transistor, having a first gate, and controlled by a voltage input circuit according to an input voltage signal; and a second MOS transistor, connected in parallel with the first MOS transistor, having a second gate, and turned on or turned off under control of an output of the detecting circuit to be in the first impedance state or the second impedance state.

5. The driving circuit of the flat display as claimed in claim 4, wherein the second field-effect transistor circuit comprises:

a third MOS transistor, having a third gate, and controlled by the voltage input circuit according to the input voltage signal; and a fourth MOS transistor, connected in parallel with the third MOS transistor, having a fourth gate, and turned on or turned off under control of the output of the detecting circuit to be in the third impedance state or the fourth impedance state.

6. The driving circuit of the flat display as claimed in claim 5, wherein the ESD circuit comprises a first ESD element and a second ESD element connected in parallel, wherein the second ESD element is turned on in the first state to enable the parallel connection and turned off in the second state to disable the parallel connection under control of the output of the detecting circuit.

7. The driving circuit of the flat display as claimed in claim 5, wherein the charging circuit path further comprises a first switch element connected in series with the first ESD element, wherein the discharging circuit path further comprises a second switch element connected in series with the second ESD element, wherein when the first switch element is turned on, the second switch element is turned on in the first state and is turned off in the second state.

8. The driving circuit of the flat display as claimed in claim 5, wherein the first and the second MOS transistors are P-type MOS transistors, and the third and the fourth MOS transistors are N-type MOS transistors.

9. The driving circuit of the flat display as claimed in claim 5, wherein the first and the second MOS transistors are N-type MOS transistors, and the third and the fourth MOS transistors are P-type MOS transistors.

10. The driving circuit of the flat display as claimed in claim 5, wherein the first, the second, the third and the fourth MOS transistors have a same conductive type.

11. The driving circuit of the flat display as claimed in claim 1, wherein the charging circuit path comprises:

a first switch, controlled by the output of the detecting circuit, and turned on in the first state to transmit a first conducting voltage or turned off in the second state;

a first MOS transistor, having a first terminal connected to a system high voltage, a first gate connected to the first switch, and having a second terminal, wherein the first MOS transistor is completely turned on in the first state, and is controlled by a voltage input circuit according to the input voltage signal in the second state; and an ESD circuit, having a first terminal coupled to the second terminal of the first field-effect transistor circuit, and a second terminal connected to the output terminal, the discharging circuit path comprises:

a second switch, controlled by the output of the detecting circuit, and turned on in the first state to transmit a second conducting voltage or turned off in the second state;

a second MOS transistor, having a first terminal connected to a ground voltage, a second gate connected to the second switch, and a second terminal connected to the second terminal of the first MOS transistor, wherein the second MOS transistor is completely turned on in the first state, and is controlled by the voltage input circuit according to the input voltage signal in the second state; and the ESD circuit in common use.

12. The driving circuit of the flat display as claimed in claim 11, wherein the first MOS transistor is a P-type MOS transistor, the second MOS transistor is an N-type MOS transistor, the first conducting voltage is the ground voltage, and the second conducting voltage is a conducting voltage of the N-type MOS transistor.

13. The driving circuit of the flat display as claimed in claim 11, wherein the first MOS transistor is an N-type MOS transistor, the second MOS transistor is a P-type MOS transistor, the first conducting voltage is a conducting voltage of the N-type MOS transistor, and the second conducting voltage is the ground voltage.

14. The driving circuit of the flat display as claimed in claim 11, wherein the charging circuit path and the discharging circuit path further comprise a switch circuit for turning on or turning off the charging circuit path.

15. The driving circuit of the flat display as claimed in claim 1, wherein the charging circuit path comprises:

a first MOS transistor, having a first terminal and a second terminal, wherein the first terminal is connected to a system high voltage;

a switch circuit, controlled by the detecting circuit when the switching circuit is turned on, wherein an impedance value of the first impedance state is smaller than an impedance value of the second impedance state;

an ESD circuit, having a first terminal coupled to the second terminal of the first MOS transistor, and a second terminal connected to the output terminal, the discharging circuit path comprises:

a second MOS transistor, having a first terminal and a second terminal, wherein the first terminal is connected to a ground voltage, and the second terminal is connected to the second terminal of the first MOS transistor;

the switch circuit in common use; and the ESD circuit in common use.

16. The driving circuit of the flat display as claimed in claim 15, wherein the switch circuit comprises:

a P-type MOS transistor; and an N-type MOS transistor, connected in parallel with the P-type transistor through a source and a drain, wherein the output voltage of the detecting circuit respectively control base voltages of the P-type MOS transistor and the N-type MOS transistor.

17. The driving circuit of the flat display as claimed in claim 1, wherein the detecting circuit is set to the first state within a predetermined delay time of the input voltage signal, and set to the second state outside the predetermined delay time.

18. The driving circuit of the flat display as claimed in claim 1, wherein the second state of the detecting circuit is more than 50% of closeness.

19. The driving circuit of the flat display as claimed in claim 1, wherein the detecting circuit comprises at least one comparator for outputting at least one control voltage, and an electric polarity of the control voltage is determined by a conductive type of an MOS device to be controlled.

* * * * *